United States Patent [19]

Fast

[11] Patent Number: 4,525,944

[45] Date of Patent: Jul. 2, 1985

[54] PRODUCT IDENTIFICATION TAG

[76] Inventor: Jacob J. Fast, 7561 NW. 9th St., Plantation, Fla. 33317

[21] Appl. No.: 519,226

[22] Filed: Aug. 2, 1983

Related U.S. Application Data

[63] Continuation-in-part of Ser. No. 473,650, Mar. 9, 1983.

[51] Int. Cl.[3] ..... G09F 1/00

[52] U.S. Cl. ..... 40/124.1; 40/19.5; 40/584

[58] Field of Search ..... 40/2, 124.1, 19.5, 584, 40/25 R

[56] References Cited

U.S. PATENT DOCUMENTS 2,199,968 5/1940 Flood ..... 40/25 R 3,706,150 12/1972 Greenberger ..... 40/124.1

3,977,109 8/1976 Berry et al. ..... 40/124.1

4,463,510 8/1984 Windish ..... 40/19.5

*Primary Examiner*—Gene Mancene

*Assistant Examiner*—Wenceslao J. Contreras

*Attorney, Agent, or Firm*—Holman & Stern

[57] ABSTRACT

An improved forwardly-extending product information tag, formed in a plastic sheet, is provided with a retainer aperture to receive the distal end of a merchandise support hook and thereby preclude transverse flexure and mispositioning of the tag. The tag includes a three-section mounting portion in which one of the sections can be folded in either of two directions to permit the tag to be mounted on different style support hooks which project from an apertured board.

19 Claims, 10 Drawing Figures

PRODUCT IDENTIFICATION TAG

CROSS REFERENCE TO RELATED APPLICATION

This patent application is a continuation-in-part application of my co-pending U.S. patent application Ser. No. 6,473,650, filed Mar. 9, 1983 and entitled "Merchandise Information Tag With Improved Mounting Arrangement". The disclosure in that application is expressly incorporated herein in its entirety.

BACKGROUND OF THE INVENTION

1. Technical Field

The present invention relates to product identification and information tags for merchandise suspended from horizontally-extending support hooks, and the like. More particularly, the present invention relates to such tags which are easily attached to and removed from the support hooks without being subject to inadvertant removal and which display the product information forwardly of the supported merchandise.

2. Discussion of the Prior Art

In FIGS. 27 and 28 of my aforesaid U.S. patent application Ser. No. 06/473,650, I disclose a product identification and information tag which is formed from a plastic sheet and which displays the product information forwardly of items suspended from a horizontally-extending hook. The hook extends from an apertured board, or the like, and the tag includes a mounting portion arranged to be temporarily deformed while being attached to and removed from the hook at a location adjacent the board. An intermediate portion of the tag, formed integrally with the support portion, projects forwardly over the support hook and the supported merchandise. A display portion, formed integrally with the intermediate and support portions, bends downwardly from the distal end of the intermediate portion and in front of the hook so as to display the desired product identification and information data.

I have discovered a number of practical problems associated with my above-described product information tag. One such problem involves the inadvertant lateral bending or flexing of the tag along its intermediate portion by customers, resulting in the display portion being positioned along the side of the suspended merchandise and therefore out of view of the customers. This bending or flexing can occur when a merchandise item is removed from an adjacent hook, by a customer accidently brushing against the tag, or in some other fashion. The problem is most severe in the case of tags having relatively long intermediate portions which are inherently more flexible transversely of their lengths.

Another practical problem concerning my prior product information tag relates to the mounting portion which is not ideally suitable for the double loop style hooks which attach directly to an aperture board. More particularly, the mounting portion of my prior tag includes a single thickness of the plastic sheet which is apertured in two locations remote from its edge to receive both legs of the hook. Slots or slits extend from the apertures to the edge of the support portion in order to provide access to the apertures for the hook legs. The slots or slits are laterally spaced by a distance which is less than the lateral spacing between the apertures so that the tag must be resiliently deformed during attachment and removal, thereby assuring that the tag will not be inadvertantly removed from its mounting position. When used with the aforesaid double loop style hook, however, my prior tag tends to slip forwardly on the hook, riding down along the downwardly curved portions of the hook legs and skewing the intermediate and display portions of the tag.

OBJECTS AND SUMMARY OF THE INVENTION

It is therefore an object of the present invention to provide an improved product identification and information tag of the type described wherein lateral flexture is minimized so that the information display portion remains positioned forwardly of the suspended merchandise.

It is another object of the present invention to provide an improved product identification and information tag of the type described in which the mounting portion is improved to permit the tag to be reliably positioned for both wireback style hooks and the double loop style hooks.

Still another object of the present invention is to provide an improved product identification and information tag designed for use with a variety of merchandise support hooks which attach to apertured boards, wherein the tag remains positionally stable once it has been deployed.

In accordance with one aspect of the present invention, a small retainer hole is defined in the intermediate portion of the tag at a location to permit the distal end of the support hook to project upwardly therethrough. The support hook thereby resists lateral flexture of the intermediate portion and maintains the display portion properly positioned in front of the merchandise. When a customer slides a merchandise item forwardly along the hook for removal of that item, the intermediate portion of the tag is consequentially flexed upward thereby to permit the item to pass the distal end of the hook. Once the item has been removed, the intermediate portion falls back down onto the hook so that the distal end of the hook once again projects upwardly through the retainer hole. The retainer hole may be configured to specifically match a particular support hook distal end configuration, or it may be universally contoured for use with a variety of different supports hooks' distal end configurations.

A further aspect of the present invention involves providing a three-section mounting portion for the tag. An end section is separated from a middle section by a first transverse fold line. The middle section is, in turn, separated from an inboard section by a second transverse fold line. The middle and inboard sections are apertured and slotted or slit so that the apertures and slots or slits are aligned when the middle and inboard sections are folded against one another along the second fold line. The apertures constitute the mounting holes by which the tag is retained on the merchandise support hook and the slots or slits produce the access to the mounting holes for the support legs from an edge of the tag defined by the second fold line. The end section of the mounting portion serves as a flap and can be folded along the first fold line to extend forwardly or rearwardly, depending upon the style of support hook with which the tag is used. When used with a wireback hook, the flap is folded to extend forwardly under the intermediate tag section, leaving the middle and inboard section in close proximity to form a double layer mounting portion of the tag. When used with the double loop style hook, the flap is folded to extend rearwardly so that its outer edge abuts a further fold line between the intermediate tag portion and the inboard section of the mounting portion. This provides a mounting portion of generally triangular longitudinal cross-section wherein the inboard section is disposed adjacent to the apertured board and the middle section diverges upwardly and forwardly with respect to the inboard section from the second fold line. The triangular cross-section functions as a structural brace which prevents the mounting portion of the tag from slipping down along the support hook.

BRIEF DESCRIPTION OF THE DRAWINGS

These and other object, features and many of the attendant advantages of the invention will be better understood upon a reading of the following detailed description when considered in connection with the accompanying drawings wherein like parts in each of the several figures are identified by the same reference numerals, and wherein.

DESCRIPTION OF THE PREFERRED EMBODIMENTS

Figure 1:
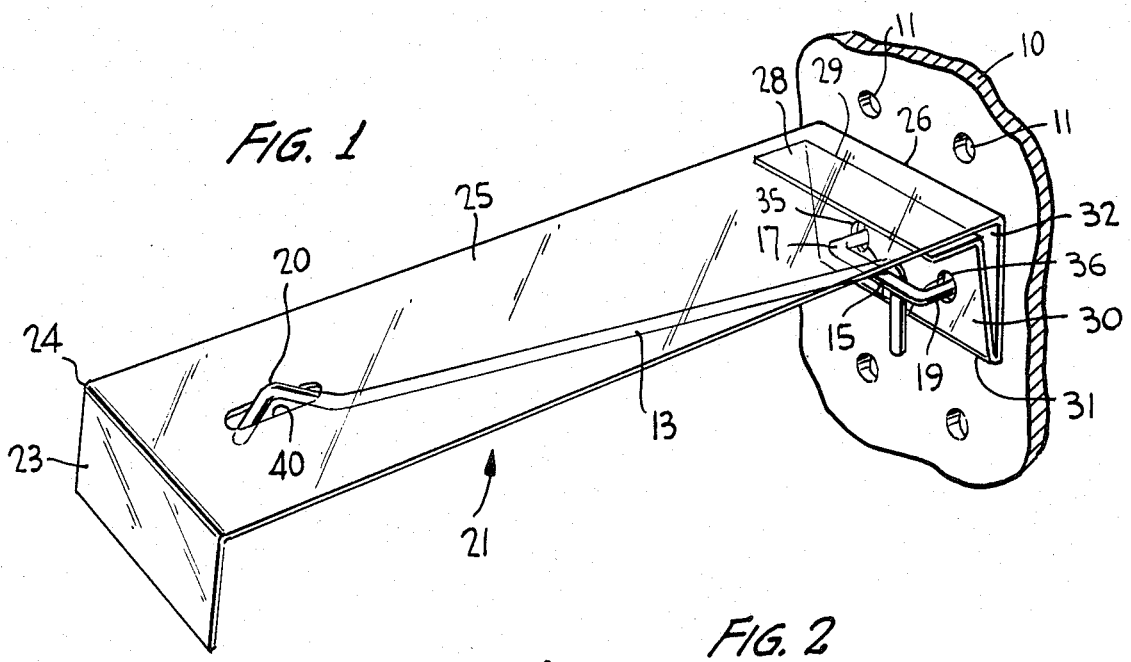
FIG. 1 is a view in perspective from above showing one form of the product identification and information tag of the present invention deployed for use with a particular form of support hook.
Figure 2:
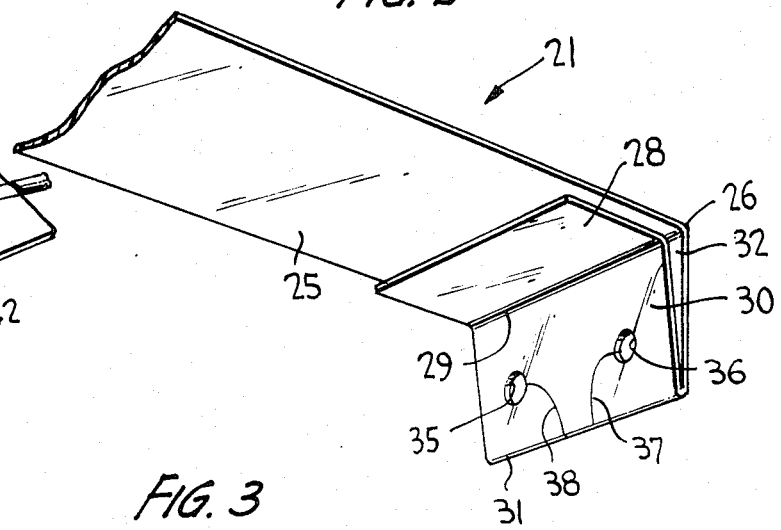
FIG. 2 is partial view in perspective from below of the product identification and information tag of FIG. 1.
Figure 3:
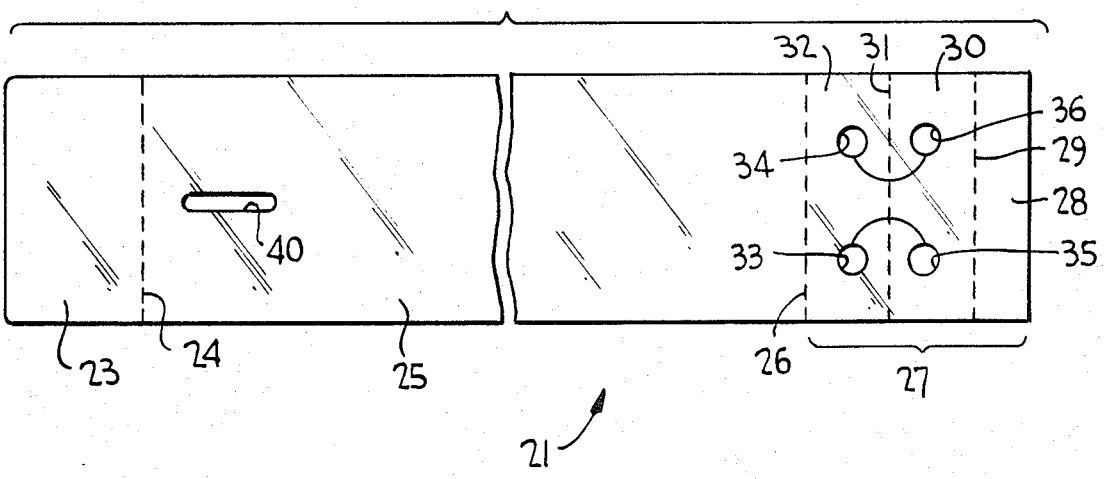
FIG. 3 is view in plan of a blank from which the product identification and information tag of FIG. 1 is formed by appropriate folding and punch out of die-cut members.

Referring specifically to FIGS. 1, 2 and 3 of the accompanying drawings, there is illustrated an apertured board 10 of the type which is conventionally employed in conjunction with merchandise displays in retail establishments. Apertures 11 defined through board 10 are regularly spaced to receive suitable merchandise support members. In the embodiment illustrated in FIG. 1, a support hook 13 has its proximal end bent downwardly and secured to a bracket member 15. The bracket member has two spaced horizontally-extending arms 17 and 19 which project through two of the apertures 11 and are bent upwardly behind board 10 (not shown) so as to retain the bracket 15 and support hook 13 in place. The support hook, when thus retained in place, projects forwardly from the apertured board 10 in a generally horizontal orientation so that merchandise, such as blister packs, with suitable support apertures defined therein may be suspended from the hook. In the case of the hook 13 illustrated in FIG. 1, the distal end thereof has an elbow bend 20 which points upwardly to facilitate retention of the merchandise items on the hook.

The product information and identification tag of the present invention takes the form of an elongated plastic sheet 21 in which suitable fold lines are impressed and appropriate apertures are die-cut. Specifically, sheet 21 is arranged in three distinct portions positioned at successive longitudinal locations along the sheet. At the distal end of sheet 21 there is disposed a display portion 23 which joins an intermediate portion 25 at a fold line 24 which extends transversely across the entire sheet. A mounting portion 27 joins the other end of intermediate portion 25 at a second fold line 26 which also extends transversely across the entire sheet 21. Mounting portion 27 constitutes the proximal end of the display tag. Mounting portion 27 is itself subdivided into three section, namely an end flap section 28, a middle section 30 and an inboard section 32. The end flap section 28 Joins the middle section 30 at another fold line 29 which extends transversely across the entire sheet 21. Likewise, intermediate section 30 joins inboard section 32 at a further fold line 31 which also extends transversely across the entire sheet. The other end of the inboard section 32 joins the intermediate portion of sheet 21 at fold line 26. Sheet 21, as described, is generally rectangular in shape with its longest dimension extending from its proximal end at end flap 28 to its distal end at display portion 23.

First and second die-cut holes 33 and 34 are defined in transversely spaced relation on opposite sides of the longitudinal center line of sheet 21 in the inboard section 32 of mounting portion 27. Third and fourth die-cut holes 35 and 36 are defined in the middle section 30 of mounting portion 27 in transverse alignment with holes 33 and 34, respectively. In addition, the longitudinal spacing of holes 33 and 34 from fold line 31 is equal to the longitudinal spacing of holes 35 and 36 from that fold line. Therefore, when middle section 30 and inboard section 32 are folded toward one another along fold line 31, holes 33 and 35 are in registration as are holes 34 and 36. Holes 33, 34, 35 and 36 serve as mounting holes for the product identification tag on the horizontally-extending arms 17 and 19 of bracket 15. In this regard, the diameter of the mounting holes is made slightly larger than the diameter of the arms 17 and 19.

A slit 27 is defined in sheet 21 and extends between mounting holes 34 and 36 across fold line 31. A similar slit 38 is defined between holes 33 and 35, also extending across fold line 31. Each slit 37, 38 is substantially symmetrical about fold line 31 so that when the sheet is folded along this line, equal halves of each slit are in registration. The slits 37 and 38 are arcuate and are closest to one another at their points of intersection with fold line 31. Thus, as best seen in FIG. 2, when the sheet is folded along fold line 31, the slits 37 and 38 provide access to the mounting holes from the edge defined by fold line 31. The intersection points of slits 37 and 38 with fold line 31 are transversely closer together than are holes 35 and 36 or holes 33 and 34. The mounting holes are spaced by a distance equal to the spacing between apertures 11 in the apertured board 10 and between the arms 17 and 19 of bracket 15. Thus, in order to deploy the tag on bracket 15 so that arms 17 and 19 extend through the registered hole pairs 34, 36 and 33, 35, the middle section 30 and inboard section 32 must be deformed at fold line 31 by bending portions of these sections out of plane. Similarly, in order to remove the tag from the bracket 15, a deformation at fold line 31 must be effected in sections 30 and 32.

In the embodiment illustrated in FIG. 1, the end flap section 28 is bent to extend forwardly from fold line 29 along the underside of intermediate portion 25 of the tag. Middle section 30 is bent along fold line 31 so as to be positioned substantially adjacent inboard section 32, thereby providing an effective double thickness in the mounting portion of the tag. This double thickness effective minimizes inadvertant movement of the tag relative to the bracket 15 so that the tag is stably positioned at its proximal end.

As best seen in FIGS. 1 and 3, the sheet 21 is provided with a longitudinally-extending slot 40 which is die-cut into the intermediate portion 25 at a longitudinal position proximate fold line 24. Slot 40 is shown extending longitudinally along the longitudinal center line of sheet 21 and is positioned so as to register with the upwardly-pointing elbow 20 at the distal end of support hook 13. Elbow 20 thus projects through slot 40 and provides sufficient lateral stability for intermediate section 25 so that the tag is precluded from flexing laterally and becoming positioned alongside rather than atop the support hook 13. If intermediate section 25 were permitted to merely rest atop elbow 20, it may be seen that one could push the distal end of the tag in a lateral direction with a relatively small force to a position where the longitudinally-extending edge of the tag would be forced beyond the elbow 20. The elbow 20 would then engage the longitudinally-extending edge of the tag and prevent it from assuming its desired illustrated position. It is only in the illustrated position that the display portion 23 of the tag is disposed forwardly of the support hook and the merchandise items suspended therefrom.

Figure 4:
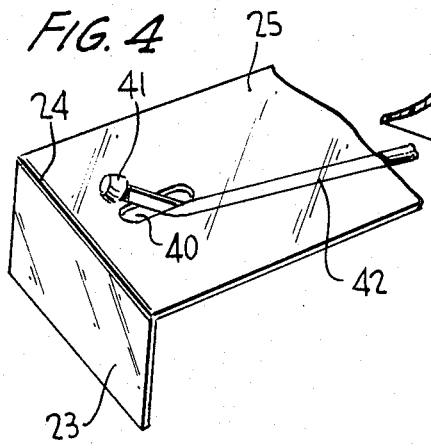
FIG. 4 is a view in perspective of the distal or forward end of the product identification and information tag of FIG. 1 shown deployed with a second form of support hook.

Referring to FIG. 4, the distal end of the tag of FIGS. 1–3 is illustrated in use in conjunction with a support hook 42 having an upwardly projecting distal end rather than an elbow joint 20. The slot 40 is positioned to engage the upwardly extending distal end 41 of support hook 42 in the same manner in which it engages the elbow joint 20 of support hook 13.

Figure 5:
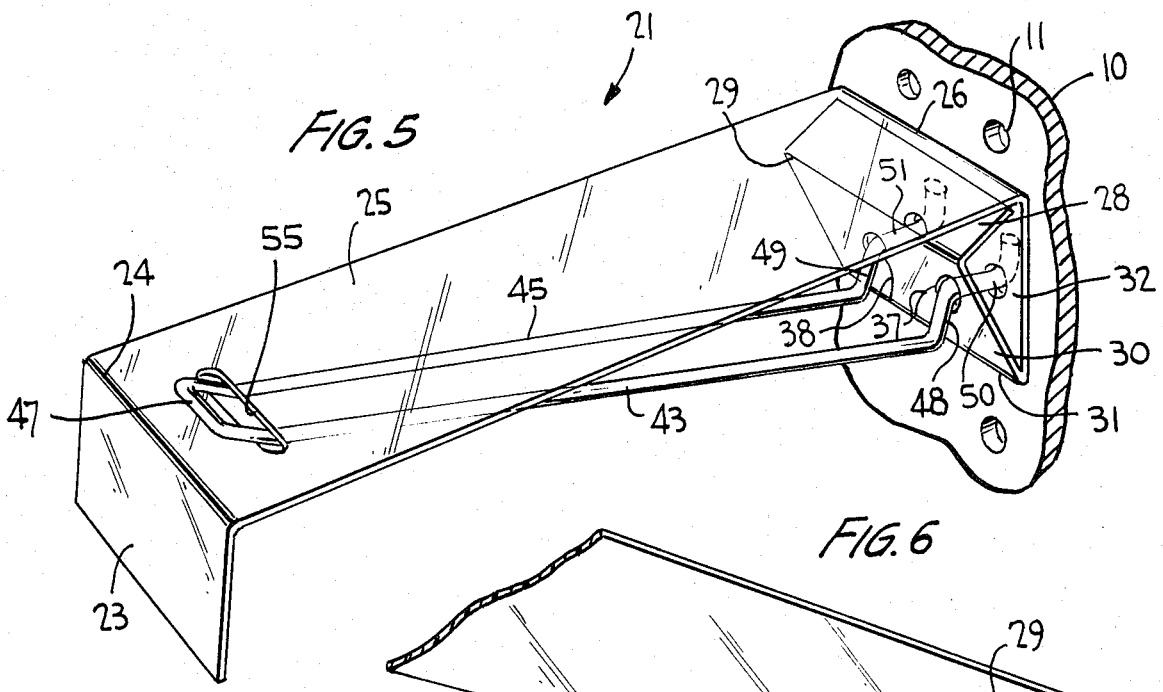
FIG. 5 is a view in perspective from above showing another form of the product identification and information tag of the present invention deployed for use with still another form of support hook.
Figure 6:
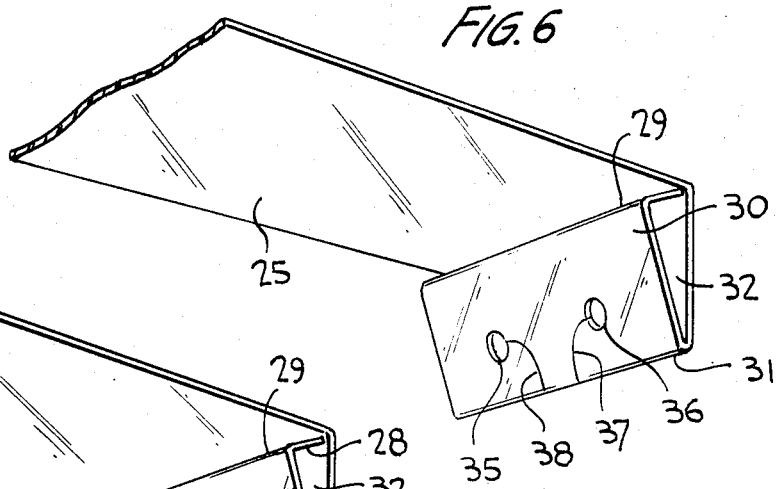
FIG. 6 is a partial view in perspective from below of the product identification and information tag of FIG. 5.

Referring now to FIGS. 5 and 6, the product identification and information tag of FIGS. 1–3 is shown deployed with a support hook of the double loop style. More particularly, the double loop style support hook is a conventional support hook made from a single metal or plastic rod bent into the desired configuration. This hook includes two substantially parallel extension members 43 and 45 which are joined at their distal ends by a transversely extending section 47. Extension sections 43 and 45 are bent slightly upward proximate the distal end of the hook so that transverse section 47 resides slightly above the rest of the support hook. The proximal ends of extension sections 43 are bent to provide generally upwardly extending sections 48 and 49, respectively. The upwardly extending sections extend along a short portion of the apertured board 10 before bending rearwardly and horizontally to define respective arms 50 and 51 which extend through respective apertures in the board 10. Arms 50 and 51 are bent upwardly behind board 10 to provide the engagement with the rear surface of the board necessary to support the hook.

When deployed in conjunction with the double loop style hook of FIG. 5, the end flap section 28 is bent rearwardly from fold line 29 so that its remote edge abuts the fold line 26 between the intermediate and mounting portions of the tag. This spaces the middle section 30 further away from inboard section 32 than is the case with the mounting arrangement of FIG. 1. The three sections of the mounting portion 27 may be seen in the embodiment of FIG. 5 to have a longitudinal cross section, when deployed, that is triangular. This triangular cross-sectional configuration provides a support brace which prevents the mounting portion from sliding down the vertical sections 48 and 49 from the horizontally-extending arms 50 and 51. It will therefore be appreciated that the tag of FIG. 3 may be deployed in either of two mounting orientations, depending upon the nature of the support hook with which it is to be used.

The retainer slot 55 employed with the embodiment of FIG. 5 extends transversely with respect to the elongated sheet 21 rather than longitudinally as is the case for slot 40. Slot 55 is positioned to receive the distal end, including transverse section 47, of the double loop style hook. This engagement of the distal end of the support hook by the transversely extending slot 55 provides the same type of lateral stability for sheet 21, and particularly intermediate portion 25, as is provided by slot 40 and its engagement of elbow 20 or end portion 41.

Figure 7:
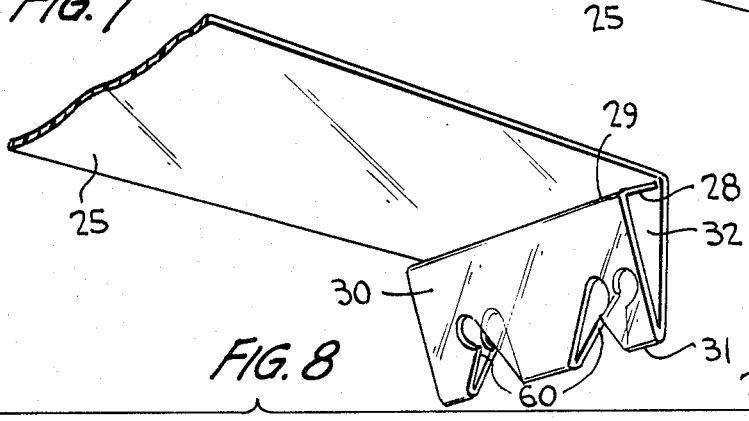
FIG. 7 is a view similar to FIG. 6 but showing a different configuration for the mounting portion of the product identification and information tag.
Figure 8:
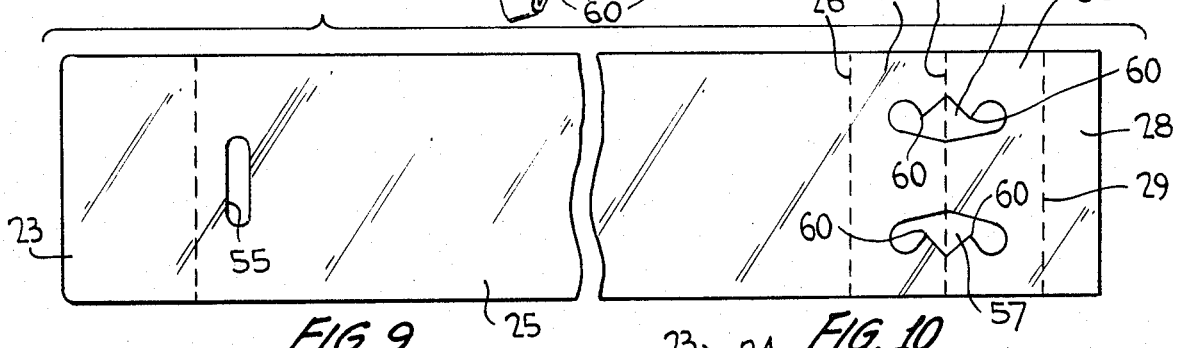
FIG. 8 is a view in plan of a blank from which the product identification and information tag of FIG. 7 is formed.

With reference to FIGS. 7 and 8 of the accompanying drawings, the tag is shown in a modified form at its mounting portion 27. Specifically, the mounting holes 33, 34, 35 and 36 and slots 37 and 38 are replaced with two die-cut mounting holes 56 and 57 which are transversely spaced and extend longitudinally between middle section 30 and inboard section 32. Mounting hole 56 and mounting hole 57 are disposed on opposite sides of the longitudinal center line of sheet 21 in symmetrical relation. In addition, the portion of mounting hole 56 disposed in the inboard section 32 is symmetrical to the portion of that mounting hole disposed in middle section 30 with respect to the transversely-extending fold line 31. A similar symmetrical relationship exists between the portions of mounting hole 57 residing in sections 30 and 32. The portions of mounting holes 56 and 57 remote from fold line 31 are contoured to surround and be supported on the spaced arm portions 50 and 51 when the sheet is folded about fold line 31 in the manner illustrated in FIGS. 5 and 7. From these support portions of the mounting holes 56 and 57, the holes diverge toward fold line 31 so that a wide open channel is defined at the fold line for receiving the respective arms 50 and 51 of the support hook. This mounting arrangement requires less deformation of the tag during attachment and removal of the tag with respect to the support hook than is the case for the mounting arrangement illustrated in FIG. 6. However, it should be noted that some deformation is required because the support holes 56 and 57 are contoured to include pointed projections 60 which are spaced from one another in each of sections 30 and 32 so as to block direct sliding of the arms 50 and 51 into the end portions of the mounting holes 56 and 57.

Figure 9:
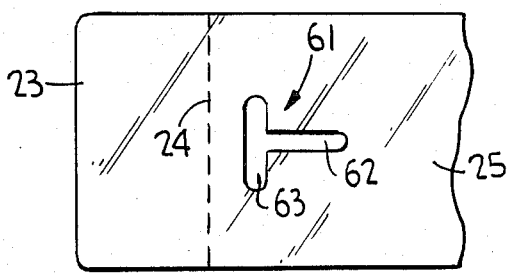
FIG. 9 is a partial view in plan of the product identification and information tag, showing an alternative retainer slot configuration.
Figure 10:
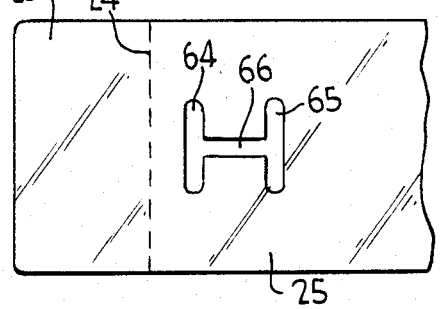
FIG. 10 is a partial view in plan of the product identification and information tag, showing another retainer slot configuration.

It is possible to provide a retainer aperture which can be universaly employed for any of the support hooks illustrated in FIGS. 1, 4 and 5. One such configuration of retainer aperture is illustrated in FIG. 9 and takes the form of a generally T-shaped die-cut 61. The retainer aperture 61 includes a stem portion 62 extending longitudinally toward fold line 24 and terminating in a transversely-extending portion 63. The stem portion 62 is positioned to receive the elbow joint 20 or distal end 41 of support hooks 13 and 42, respectively. The transversely-extending slot 63 is positioned to receive the distal end 47 of the double loop style hook of FIG. 5. The embodiment of FIG. 10 shows a retainer aperture having a generally H-shaped slot with two transversely-extending slot sections 64 and 65 spaced by a connecting longitudinally-extending slot 66. The longitudinally-extending slot is adapted to receive the appropriate portions of the support hooks illustrated in FIGS. 1 and 4. The transversely-extending slots 64 and 65 are adapted to receive the distal end of different length double loop style support hooks of the type illustrated in FIG. 5. Thus, since double loop style support hooks are currently sold at 6 and 6½" lengths, the retainer slot configuration of FIG. 10 may be considered to be useful for support hooks of both lengths. The retainer slots of FIGS. 9 and 10 may thus be considered to be "universal" in application in that they are adapted to receive a relatively large variety of support hook configurations.

From the foregoing it will be appreciated that the invention makes available a novel product identification and information display tag of the type wherein the tag extends forwardly from an apertured board to display the information in front of the suspended merchandise items and wherein inadvertant lateral flexure of the tag is minimized. In addition, the mounting structure for such a tag is improved to render it useful for a wide variety of support hooks presently offered commercially.

Having described embodiments of a new and improved product identification and information tag constructed in accordance with the present invention, it is believed that other modifications, variations and changes will be suggested to those skilled in the art in light of the above teachings. It is therefore to be understood that all such variations, modifications and changes are believed to fall within the scope of the invention as defined in the appended claims.

It will be seen that the three (3) section mounting portion of the tag of the instant invention provides increased strength relative to prior art construction, reducing ihe tendency of the elongated horizontally extending portion to be deflected from side to side without substantially increasing the weight of the ultimate product.

What is claimed is:

1. An article of manufacture in the form of an elongated flexible plastic sheet having first and second ends, display, intermediate and mounting portions disposed at successive longitudinal locations along said sheet, and first and second transversely-extending fold lines impressed into said sheet and extending transversely across the entire sheet, wherein said display portion includes said first end and is separated from said intermediate portion by said first fold line, wherein said mounting portion includes said second end and is separated from said intermediate portion by said second fold line, wherein said intermediate portion is substantially longer than each of said display and the mounting portions, and wherein said mounting portion has a plurality of die-out transversely-spaced apertures defined therein wherein said mounting portion includes a flap section located at said second end of said sheet, a middle section separated from said flap section by a third transversely-extending fold line impressed into said sheet and extending transversely across the entire sheet, and an inboard section separated from said middle section by a fourth transversely-extending fold line and pressed into said sheet and from said intermediate portion of said sheet by said second fold line.

2. The article of manufacture according to claim 1 wherein said plurality of die-cut apertures include first and second transversely-spaced apertures defined in said middle section of said mounting portion at a predetermined distance from said fourth fold line, and third and fourth transversely-spaced apertures defined in said inboard section of said mounting portion at the same predetermined distance from said fourth fold line, said first and second apertures being longitudinally aligned with said third and fourth apertures, respectively, so that upon folding of said sheet along said fourth fold line to place said middle and inboard sections in substantial parallel adjacency, said first aperture registers with said third aperture and said second aperture registers with said fourth aperture.

3. The article of manufacture according to claim 2 further comprising first and second die-cut slits of substantially negligible transverse thickness defined in said mounting portion of said sheet, said first slit extending between said first and third apertures, said second slit extending between said second and fourth apertures.

4. The article of manufacture according to claim 3 wherein said first and second slits are transversely closer together at said fourth fold line than at any other place along their lengths.

5. The article of manufacture according to claim 4 wherein said slits are each arcuate with convex sides facing one another.

6. The article of manufacture according to claim 4 further comprising a die cut hole defined in said intermediate portion of said sheet proximate said first fold line, remote from said second fold line, and substantially centered transversely of said sheet.

7. The article of manufacture according to claim 1 wherein said plurality of die-cut apertures include first and second apertures, each defined in said middle and inboard sections in transversely-spaced relation and including substantially identically configured halves disposed symmetrically in a longitudinal sense with respect to said fourth fold line.

8. The article of manufacture according to claim 7 wherein said first and second apertures are closer together at said fourth fold line than at any longitudinal location.

9. The article of manufacture according to claim 8 further comprising a die-cut hole defined in said intermediate portion of said sheet proximate said first fold line, remote from said second fold line, and substantially centered transversely of said sheet.

10. An article of manufacture in the form of an elongated flexible plastic sheet having first and second ends, display, intermediate and mounting portions disposed at successive longitudinal locations along said sheet, and first and second transversely-extending fold lines impressed into said sheet and extending transversely across the entire sheet, wherein said display portion includes said first end and is separated from said intermediate portion by said first fold line, wherein said mounting portion includes said second end and is separated from said intermediate portion by said second fold line, wherein said intermediate portion is substantially longer than each of said display and the mounting portions, and wherein said mounting portion has a plurality of die-cut transversely-spaced apertures defined therein, further comprising a die-cut hole defined in said intermediate portion of said sheet proximate said first fold line, remote from said second fold line, and substantially centered transversely of said sheet wherein said die-cut hole is generally T-shaped with a stem portion extending longitudinally of said sheet and a cross portion extending transversely of said sheet at a location closer to said first fold line than is said stem portion.

11. An article of manufacture in the form of an elongated flexible plastic sheet having first and second ends, display, intermediate and mounting portions disposed at successive longitudinal locations along said sheet, and first and second transversely-extending fold lines impressed into said sheet and extending transversely across the entire sheet, wherein said display portion includes said first end and is separated from said intermediate portion by said first fold line, wherein said mounting portion includes said second end and is separated from said intermediate portion by said second fold line, wherein said intermediate portion is substantially longer than each of said display and the mounting portions, and wherein said mounting portion has a plurality of die-cut transversely-spaced apertures defined therein, further comprising a die-cut hole defined in said intermediate portion of said sheet proximate said first fold line, remote from said second fold line, and substantially centered transversely of said sheet wherein said die-cut hole is generally H-shaped with two parallel slots extending parallel to said first fold line and a longitudinal slot joining said two parallel slots.

12. In combination: a merchandise identification and information tag, an apertured support board, and a support hook having a distal end which projects horizontally forward from said apertured board and attaches to said board by means of two spaced arms adapted to fit through and engage the rear side of the board, said tag comprising an integral flexible elongated plastic sheet including:

a mounting portion including a mounting means for attaching said mounting portion to said two spaced arms adjacent the front side of said board;

an intermediate portion extending forwardly from said mounting portion to rest atop said support hook, said intermediate portion adjoining said mounting portion at a first transverse fold in said sheet; and a display portion extending downwardly from the forwardmost end of said intermediate portion at a location which is forwarded of said distal end of said support hook, said display portion adjoining said intermediate portion at a second transverse fold in said sheet.

13. The combination according to claim 12 wherein said intermediate portion of said sheet has retainer means defined therein at a location aligned with said distal end of said support hook for resisting transverse flexure of said sheet, said retainer means comprising a retainer hole for receiving said distal end.

14. The combination according to claim 13 wherein said mounting portion comprises an end flap section, a middle section and an inboard section positioned in longitudinal sequence, said flap section adjoining said middle section at a third transverse fold in said sheet, said inboard section adjoining said middle section at a fourth transverse fold in said sheet, said inboard section adjoining said intermediate portion of said sheet at said second transverse fold line.

15. The combination according to claim 14 wherein said middle section is folded forwardly and upwardly along said fourth transverse fold line generally toward said inboard section, and wherein said mounting means includes first and second transversely spaced mounting holes in said intermediate section and third and fourth transversely spaced mounting holes in said inboard section, said first and second mounting holes being disposed in substantial registration with said third and fourth mounting holes, respectively, when said intermediate section is folded generally toward said inboard section, the transverse spacing between said first and second mounting holes and between said third and fourth mounting holes being substantially equal to the spacing between said arms of said support hook, whereby one support hook arm passes through said first and third mounting holes and the other support hook arm passes through said second and fourth mounting holes.

16. The combination according to claim 15 wherein said end flap section extends forwardly of said middle section beneath the intermediate portion of said sheet.

17. The combination according to claim 15 wherein said end flap section extends rearwardly from said third fold and has an outer transversely-extending edge which abuts said second fold.

18. The combination according to claim 15 wherein said mounting means further comprises slots defined in said intermediate and inboard sections extending from said fold lines to respective mounting holes.

19. The combination according to claim 15 wherein said mounting means further comprises slits of substantially negligible width defined in said intermediate and inboard sections extending from said fold lines to respective mounting holes.

* * * * *